US008894068B2

(12) United States Patent
Rice et al.

(10) Patent No.: US 8,894,068 B2
(45) Date of Patent: Nov. 25, 2014

(54) MULTI-TARGET DART GAME

(75) Inventors: Patrick G. Rice, Loves Park, IL (US); Matthew Samuel Malmberg, Rockford, IL (US); Richard F. Jones, Rockford, IL (US); Thomas P. Myers, Machesney Park, IL (US)

(73) Assignee: B.I.G. Three Sixty LLC, Loves Park, IL (US)

( * ) Notice: Subject to any disclaimer, the term of this patent is extended or adjusted under 35 U.S.C. 154(b) by 200 days.

(21) Appl. No.: 13/480,873

(22) Filed: May 25, 2012

(65) Prior Publication Data

US 2012/0299244 A1 Nov. 29, 2012

Related U.S. Application Data

(60) Provisional application No. 61/490,412, filed on May 26, 2011.

(51) Int. Cl.

| | |
|---|---|
| ***F41J 5/04*** | (2006.01) |
| ***F41J 5/052*** | (2006.01) |
| ***F41J 3/00*** | (2006.01) |

(52) U.S. Cl.

CPC ..... *F41J 3/0028* (2013.01); *F41J 5/052* (2013.01); *F41J 3/0061* (2013.01)

USPC ..... 273/371

(58) Field of Classification Search

USPC ..... 273/371–377, 403, 404, 407, 408; 473/10, 14

See application file for complete search history.

(56) References Cited

U.S. PATENT DOCUMENTS 3,836,148 A * 9/1974 Manning ..... 273/368
4,415,162 A * 11/1983 Sheppard ..... 273/371

(Continued)

FOREIGN PATENT DOCUMENTS

| | | | | |
|---|---|---|---|---|
| CH | 646248 A5 * | 11/1984 | ..... | F41J 5/04 |
| DE | 101 07 985 C1 | 4/2002 | | |
| ES | 2187302 | 11/2004 | | |
| WO | WO 91/15729 | 10/1991 | | |

OTHER PUBLICATIONS

PCT—International Application No. PCT/US2012/039618 Notification of Transmittal of the International Search Report and the Written Opinion of the International Searching Authority, or the Declaration—Mailed Aug. 7, 2012.

*Primary Examiner* — Mark Graham

(74) *Attorney, Agent, or Firm* — Leydig, Voit & Mayer, Ltd.

(57) ABSTRACT

A multiple target electronic dart gaming machine having shared electronic components. According to certain embodiments, the multiple targets are mounted on opposite sides of a game board of a target assembly that is housed in a cabinet of the gaming machine. The gaming machine may be floor-standing or wall mountable. Either affixed above the top of the target assembly, below the bottom of the target assembly, or both, is a visual display video monitor for providing players and observers with game scores and the like. The game board may be axially rotated between at least first and second positions so as to allow game play on the different targets. Additionally, the position of the game board may be detected through the use of a detector on or in the board.

15 Claims, 8 Drawing Sheets

(56) References Cited

U.S. PATENT DOCUMENTS

| | | | | | |
|---|---|---|---|---|---|
| 4,565,527 | A * | 1/1986 | Burchett | 434/248 |
| 4,974,857 | A * | 12/1990 | Beall et al. | 273/371 |
| 5,020,806 | A | 6/1991 | Martin | |
| 5,813,511 | A * | 9/1998 | Takemoto et al. | 194/217 |
| 6,659,467 | B2 * | 12/2003 | Ross | 273/407 |
| 6,926,278 | B2 * | 8/2005 | Bibi | 273/284 |
| 7,523,942 | B2 * | 4/2009 | Chung | 273/317.1 |
| 2005/0049056 | A1 * | 3/2005 | Padilla | 473/10 |
| 2009/0305801 | A1 * | 12/2009 | Chung | 473/14 |
| 2012/0122569 | A1 * | 5/2012 | Kowolik et al. | 463/30 |

* cited by examiner

MULTI-TARGET DART GAME

RELATED APPLICATIONS

This application claims priority to U.S. Application No. 61,490,412, having a filing date of May 26, 2011, which is incorporated herein by reference in its entirety.

BACKGROUND OF THE INVENTION

The present invention relates generally to pay-for-play, self-scoring electronic dart games. More particularly, the present invention relates to electronic dart games having multiple targets.

Self-scoring, electronic, single target dart games typically offer a limited number of game play options. However, given the limited space often available for such games, the number or types of games available to players are limited. Further, the use of multiple target games are typically limited to the space constraints. More specifically, such multi-target games often require sufficient space to allow for maneuvering of the targets as the targets are changing position. Further, such changes in targets typically require that the game be manually operated, such as by a third-party attendant who may collect payment for game play, provide the darts to the players, and ensure the participants comply with the rules of game play. Further, such multi target gaming machines, if electronic, are complex and require a substantial number of duplicative electronics for use with the different targets.

BRIEF SUMMARY OF THE INVENTION

The present invention relates to multiple target dart games utilizing axial rotation of a game board that provides the players options as to the target on the gaming machine that is to be used for game play. Further, certain embodiments of the present invention are for use in coin-operated industry environments where dart games are adapted with an automatic fee-for-play collection mechanism. Such coin-operated industry environments allow players to pay-for-play by inserting the necessary fee into the dart game for desired game selection and launch without the need for a third-party attendant. Additionally, players also remove their own darts from the dart target as needed to continue game play until game completion.

Embodiments of the present invention also provide a robust multiple target electronic dart game with axial rotation that also reduces production costs through the use of shared electrical components.

Additionally, embodiments of the present invention also provide a user friendly mechanism to allow players to move and latch into place a player selected and/or preferred target. Further, according to certain embodiments, the present invention provides a robust and re-enforced dual purpose latch and release mechanism optimally positioned to withstand powerful physical blows to the invention by players, such as players frustrated or overzealous with their game play, before, during and after dart removal from a target. Additionally, embodiments of the present invention provide a contactless target positioning mechanism, such as, for example, a magnetic field detector, which is optimally positioned for reliable, consistent target position detection.

One aspect of the present invention is a gaming machine having a game controller that includes a cabinet having a front portion and a back portion. The gaming machine also includes a game board that is rotatably secured to the cabinet. The game board includes a first target side, a second target side, and a detector. The first target side is configured for game play of a first game, and the second target side is configured for game play of a second game. The game board is rotatable about the cabinet between at least a first position and a second position. The first target side faces the front portion of the cabinet when the game board is in a first position, while the second target side faces the front portion when the game board is in the second position. The detector is configured for the detection of a position of the game board relative to the cabinet. Further, the game controller is configured to determine whether the game board is in the first or second position based on the position of the game board detected by the detector. The gaming machine further includes a latch mechanism that is operably connected to the game board. The latch mechanism, which includes a handle and a bolt, is configured to engage the cabinet to releasably retain the game board in a first or second position.

According to another aspect of the present invention is a gaming machine that includes a target assembly secured to a cabinet. The target assembly includes a multi-sided game board, a game controller, and a magnetic field detector. The multi-sided game board is rotatable about the cabinet between at least a first position and a second position. Further, the multi-sided game board also includes at least two target sides that are configured for play of electronic dart games. The magnetic field detector is configured to detect a magnetic field generated by one or more magnets positioned in the cabinet. The game controller is configured to determine whether the multi-sided game board is in a first or second position based on the polarity of the magnetic field detected by the magnetic field detector.

A further aspect of the present invention is a gaming machine having a cabinet having a first side and a second side. The gaming machine also includes a target assembly that is secured to the cabinet. The target assembly has a multi-sided game board, a game controller, and a magnetic field detector. The multi-sided game board is rotatable about the cabinet between at least a first position and a second position. Additionally, the multi-sided game board includes at least two target sides configured for play of electronic dart games. The magnetic field detector is configured to detect a first magnetic field that is generated by a first magnet positioned in proximity to the first side of the cabinet. The magnetic field detector is also configured to detect a second magnetic field generated by a second magnet positioned in proximity to the second side of the cabinet. Further the first and second magnetic fields have a different polarity. The game controller is configured to determine whether the multi-sided game board is in a first or second position based on the polarity of the magnetic field detected by the magnetic field detector. Additionally, the game controller used for score detection for the first target side is the same game controller used for score detection for the second target side.

Figure 1:
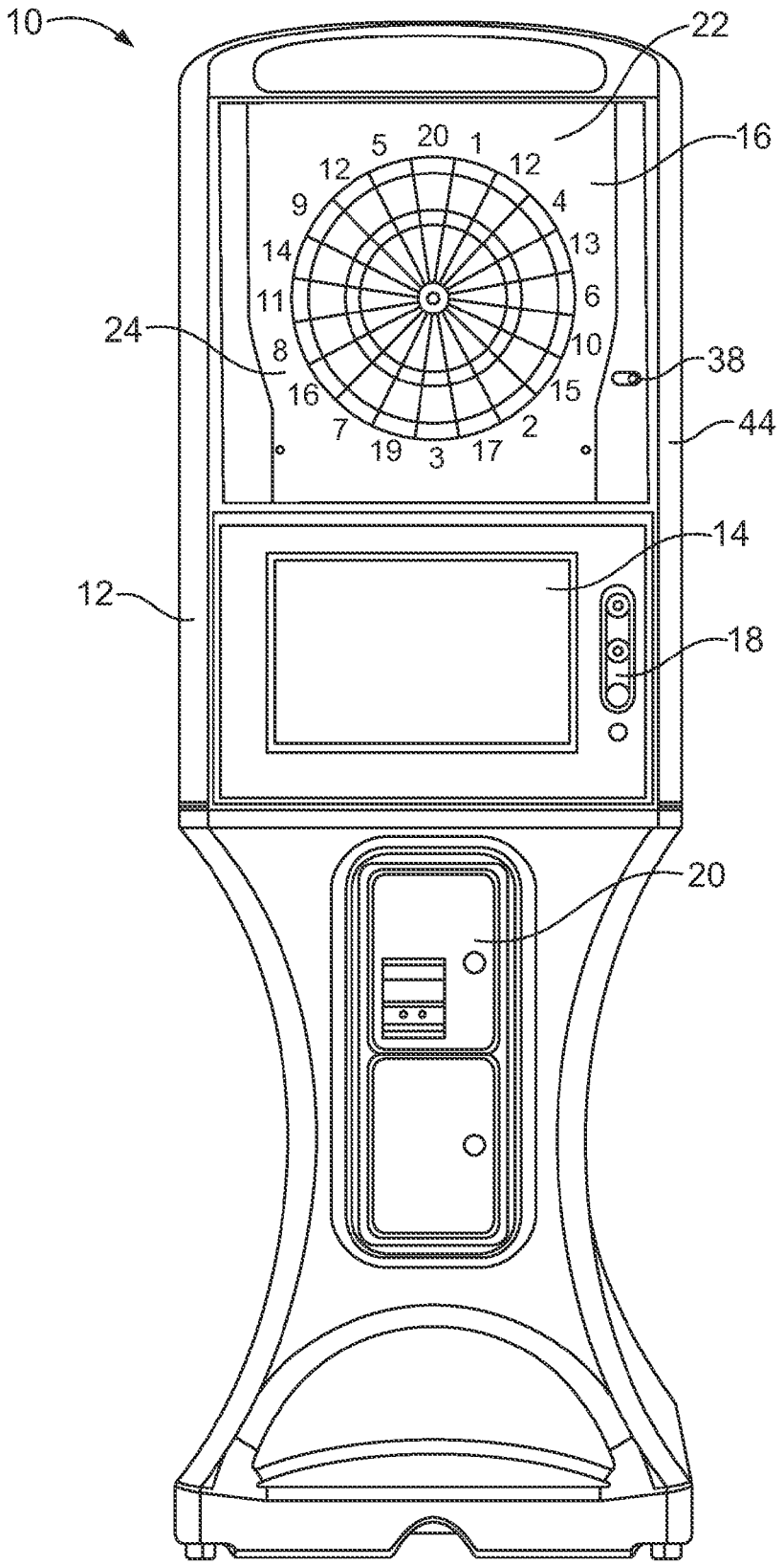
FIG. 1 illustrates a multiple target dart game according to an illustrated embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a multi-target gaming machine 10 according to an illustrated embodiment of the present invention. The multi-target gaming machine 10 includes a cabinet 12 that houses a display 14, a target assembly 16, and a main game processor. The cabinet 12 may also house or support a player input device 18, such as, for example, a plurality of buttons or switches. Alternatively, according to other embodiments, the player input device 18 may be a touch screen on the display 14. Additionally, the gaming machine 10 may also be configured for electronic scoring detection for multiple target games and/or shared scoring components as disclosed in U.S. Pat. Nos. 5,020,806 and 7,402,793 to Martin et al., which are incorporated herein by reference in their entirety.

The player input device 18 of the gaming machine 10 may be used for a variety of game play related operations, including, for example, during game selection, game start, selection of number of players for game play, and/or switching identification of current player(s) playing the game, among other functions. The main game controller may also include memory that is used to store game play information. For example, the main game controller may store information regarding different types of games for game play on the gaming machine 10. The main game controller may also be configured to control the information and/or images displayed on the display 14, such as, for example, the score of the game, the number of players, and/or an indication of the type of game being played, among other information and/or images.

The cabinet 12 may also include a payment mechanism 20 that is configured to receive payment for game play on the gaming machine 10. According to certain embodiments, the payment mechanism 20 is a pay-for-play mechanism such that the payment mechanism receives payment for games that are about to be played on the gaming machine 10 without the need for a third-party attendant. Moreover, according to certain embodiments, the player may use the player input device 18 to make selections for game play, such as the game to be played and/or the number of players playing the game before and/or after inserting payment into the payment mechanism 20. The payment mechanism 20 may be operably connected to the main game controller of the gaming machine 10 such that the main game controller receives an indication of when payment for game play has been inputted into the payment mechanism 20. According to certain embodiments, the payment mechanism 20 may also be configured to indicate the type, amount, and/or denomination of the currency inserted into the payment mechanism 20. Additionally, according to certain embodiments, the main game controller may be configured to determine whether the payment received by the payment mechanism 20 is sufficient for the requested game play.

According to illustrated embodiments, the target assembly 16 includes a multi-sided game board 22. For example, referencing FIGS. 1 and 2, the game board 22 has a first target side 24 and a second target side 26 on opposite sides of the game board 22. According to certain embodiments, at least a portion of the first and second target sides 24, 26 may provide a playing surface used for game play. For example, according to certain embodiments, at least a portion of the first and second target sides 24, 26 may be configured for use as an electronic dart board. According to other embodiments, the first and second target sides 24, 26 may be configured to support a playing surface, such as a dart board that is hung or otherwise attached or connected to the first and second target sides 24, 26.

According to certain embodiments, the first target side 24 may have a configuration, such as indicia, for example, that is used for play of at least one game that is different than the configuration of the second target side 26. For example, in embodiments in which the gaming machine 10 is at least used for the play of a dart game(s), the indicia on the first target side 24 may provide a standard dart board, such as shown in FIG. 1, while the indicia on the second target side 26 may provide a different dart game, such as dart baseball or golf, among others.

If the player(s) desires to play a game on a target side 24, 26 of the game board 22 that is not presently positioned relative to the cabinet 12 for game play, the player may axially rotate the game board 22 until the desired target side 24, 26 is oriented for game play. For example, when game play is to commence using the first target side 24, the game board 22 may be moved (if needed) relative to the cabinet 12 such that the game board 22 is in a first position. In the illustrated embodiment, when the game board 22 is in the first position, the player may be able to simultaneously view both the display 14 and the first game target side 24, as shown in FIG. 1. When game play is to commence using the second target side 26, the orientation of the game board 22 relative to the cabinet 12 may change so that the game board 22 is in a second position. In the illustrated embodiment, with the game board 22 in the second position, the player may be able to simultaneously view both the display 14 and the second game target side 26.

Figure 2:
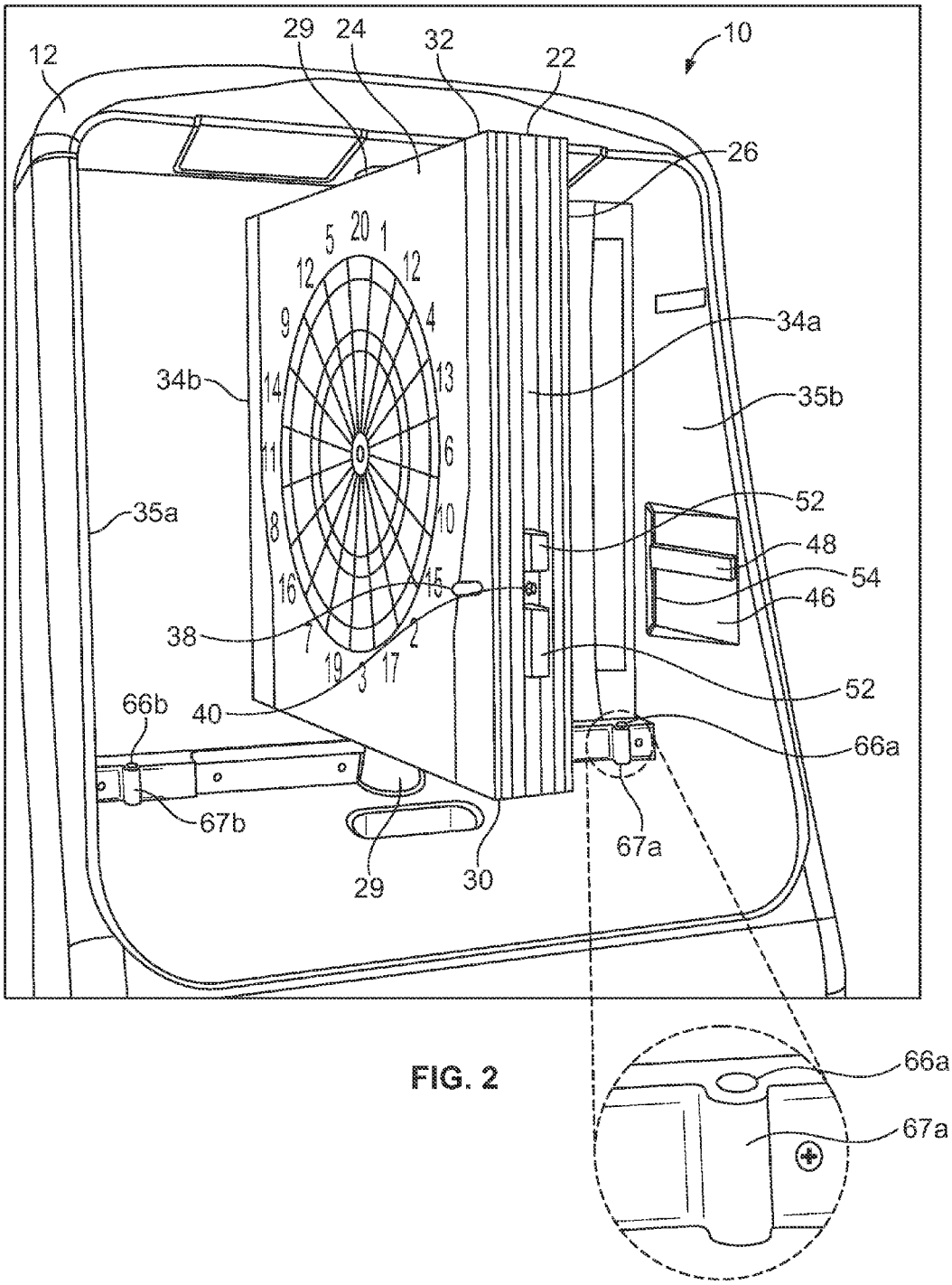
FIG. 2 illustrates a portion of a target assembly having a multi-target game board that is axially rotated between playing positions according to an illustrated embodiment of the present invention.

FIG. 2 illustrates a portion of the target assembly 16 with the game board 22 being axially rotated between playing positions, such as, for example between first and second positions. As shown, the game board 22 is operably connected to at least one shaft that is secured to the cabinet 12. Referencing FIGS. 2 and 3, according to certain embodiments, the shaft 28 may be housed in one or more bosses 29 in the cabinet 12 and is configured to be rotated when the target side 24, 26 of the game board 22 that is to be used for game play is to be changed, such as, for example, being moved from the first position to the second position, and vice versa. The shaft 28 may have a generally cylindrical configuration that allows the shaft 28 to be axially rotated in a mount or other connection or attachment in or to the cabinet 12. Alternatively, rather than the game board 22 rotating with the shaft 28, the game board 22 may be configured to be rotated about the shaft 28. The gaming machine 10 may be configured to allow the game board 22 to be rotated a full 360 degrees, or may otherwise include restrictions that limit the degree the game board 22 may be rotated, such as, for example, limiting the rotation of the game board 22 to 180 degrees.

Figure 3:
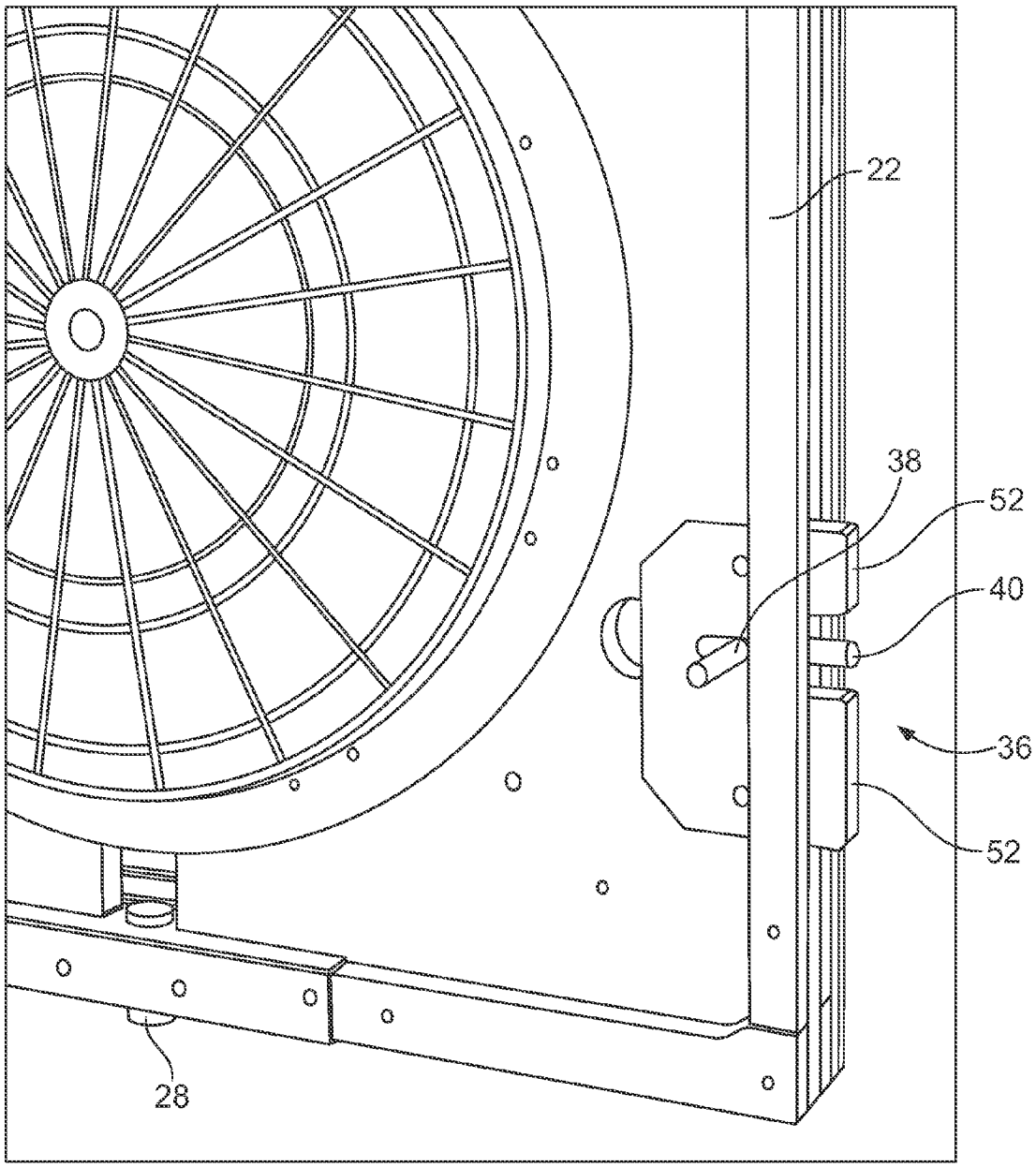
FIG. 3 illustrates a portion of a target assembly having a release or latch mechanism according to an illustrated embodiment of the present invention.

The target assembly 16 may be configured for the game board 22 to be axially rotated in any number of directions, such as along an axis that is generally perpendicular, parallel, or at an angle to the floor, or any combination thereof. For example, the shaft 28 may extend through the game board 22 so as to be operably attached to the cabinet 12 both above and below the game board 22. Alternatively, the shaft 28 may include a lower shaft and/or an upper shaft, with the lower shaft extending from the bottom 30 of the game board 22 to the cabinet 16, and the upper shaft extending from the top 32 of the game board 22 to the cabinet 12. For example, FIG. 3 illustrates a first lower shaft 28 that extends into the bottom 30 of the game board 22. According to such an embodiment, a second upper shaft 28 may extend from the top 32 of the game board 22 to the cabinet 16. Alternatively, rather than the shaft(s) 28 extending from the bottom 30 and/or top 32 of the game board 22, the shaft(s) 28 may extend from the sides 34*a*, 34*b* of the game board 22 to adjacent sides 35*a*, 35*b* in the cabinet 12.

Figure 4:
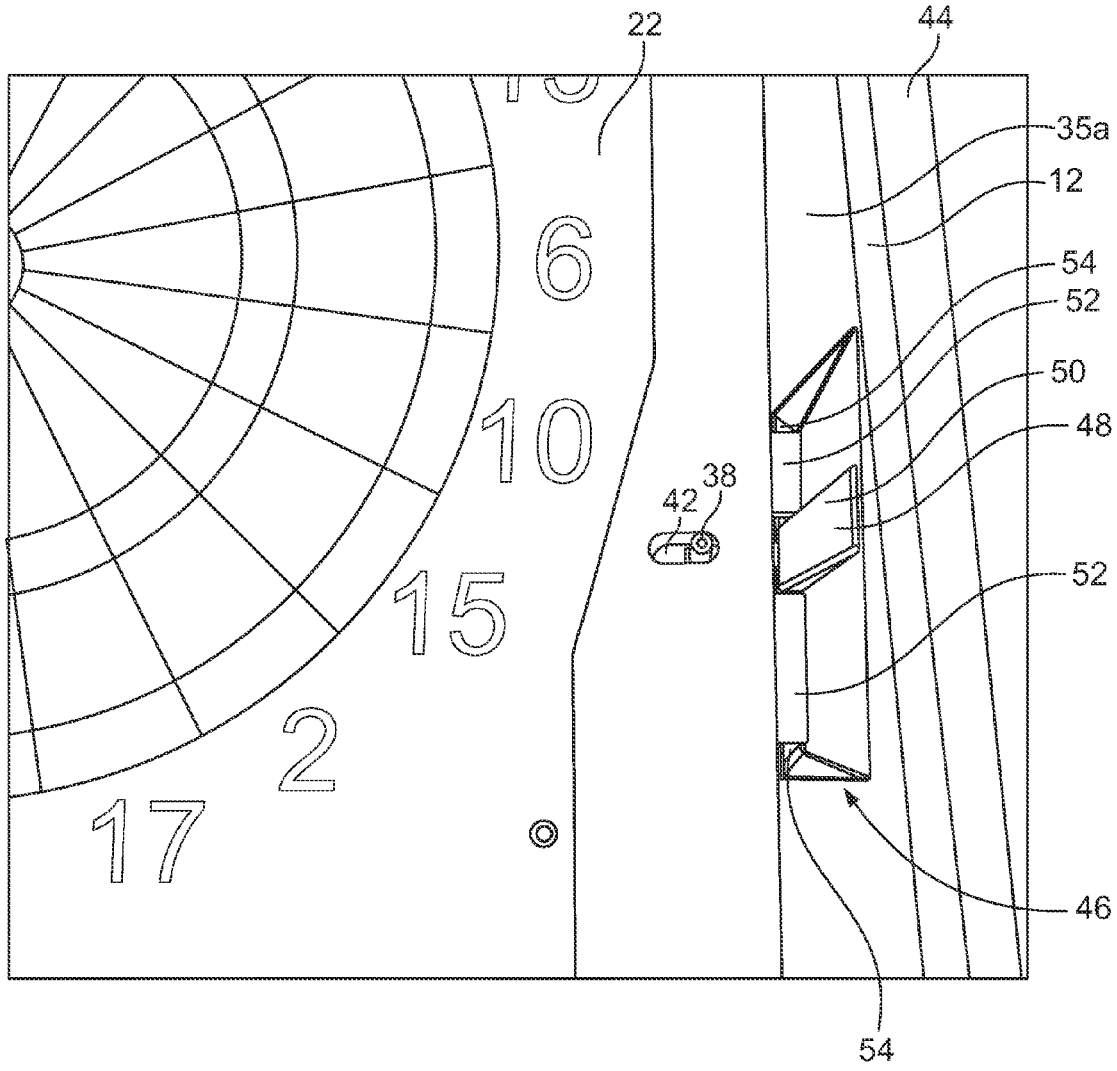
FIG. 4 illustrates a rear view of a portion of a cabinet and a target assembly for use with a gaming machine according to an illustrated embodiment of the present invention.

FIG. 3 illustrates a portion of a target assembly 16 having a release or latch mechanism 36 according to an embodiment of the present invention. The latch mechanism 36 is configured to at least assist in retaining, when desired, the game board 22 in the first or second position. According to certain embodiments, the latch mechanism 36 includes a handle 38 and a spring loaded bolt 40. The spring may be configured to bias the bolt 40 in a locked position, whereby the bolt 40 is being pushed or pulled by the spring in a direction away from the game board 22. The handle 38 may be operably connected to the bolt 40 such that the displacement of the handle 38 may be used to pull the bolt toward the game board 22 such that the bolt 40 moves from the locked position to an unlocked position. According to certain embodiments, the handle 38 may extend through an opening 42, as illustrated in FIG. 4, in both the first and second target sides 24, 26 such that the player(s) may have access to the handle from a front portion 44 of the cabinet 12 regardless if the game board 22 is in the first or second position. Alternatively, the handle 38 may consist of separate handles that each individually extend through different sides of the multi-sided game board 22. The opening 22 is configured to accommodate the displacement of the handle 38. For example, according to certain embodiments, the opening 42 may have a generally elongated configuration.

FIG. 4 illustrates a rear view of a portion of the cabinet 12 and target assembly 16. According to certain embodiments, both sides 35*a*, 35*b* of the cabinet 12 may include a recess 46 that is configured for engagement with the latch mechanism 36 so as to lock the position of the game board 22 relative to the cabinet 12. For example, the first side 35*a* of the cabinet 12 may include a recess 46 that is configured to receive a strike plate 48 that guides the bolt 40 into locking engagement with the cabinet 12. In the illustrated embodiment, the strike plate 48 may include an angled surface 50 that is configured to ensure that the bolt 40 slides into a locked position.

More specifically, as the game board 22 is being axially rotated to the first position and the user is not displacing the handle 38, the bolt 40 may be outwardly biased from the game board 22 by the spring. Therefore, when the bolt 40 initially engages the angled surface 50, the bolt 40 may be at or around its full outwardly extended locked position from the game board 22. As the game board 22 continues to be axially rotated, the angled configuration of the angled surface 50 may cause the bolt 40 to continue to be inwardly depressed into the game board 22, thereby further compressing the biasing spring of the latch mechanism 36. After the depressed bolt 40 reaches the end of the angled surface 50 of the strike plate 48 so that the angled surface 50 is no longer inwardly depressing the bolt 40, the spring is able to return the bolt 40 to its outwardly extended locked position in an area of the recess 46 behind the angled surface 50, thereby locking the position of the game board 22 relative to the cabinet 12.

Similarly, according to certain embodiments, when the game board 22 is to change positions, the user may inwardly displace the handle 38 so as to draw at least a portion of the bolt 40 toward the game board 22 so that the bolt 40 is withdrawn from the recess 46 and has sufficient clearance to pass over the angled surface 50 of the strike plate 48. The game board 22 may then be axially rotated to another position, such as being rotated from the first position to the second position. Thus, when the game board 22 in the illustrated embodiment is moved to the second position, the latch mechanism 36 may engage a similar strike plate 48 located at second side 35*b* of the cabinet 12 before the game board 22 is secured at the second position.

As shown in FIGS. 2-4, the latch mechanism 36 may also include at least one reinforcement protection block 52 positioned in proximity to the bolt 40, such as, for example, above and/or below the bolt 40. The reinforcement protection blocks 52 are configured to be received by the recess 46 in the sides 35*a*, 35*b* of the cabinet 12. Additionally, the reinforcement blocks 52 may be configured to limit the direction and degree to which the game board 22 may be rotated. For example, the reinforcement blocks 52 may extend into the recess 46 so that the reinforcement blocks 52 abut against a back wall 54 in the recess 46 that prevents the latch mechanism 36 from being rotated beyond the recess 46. Additionally, according to embodiments in which the game board 22 has two target sides, the reinforcement blocks 52 may limit the rotation of the game board 22 to 180 degrees. Further, reinforcement blocks 52 may be sized to be fitted in the recess 46 so as to provide stability to the game board 22 that limits the movement of the game board 22 when the game board is struck by a playing object, such as a dart.

Figure 5:
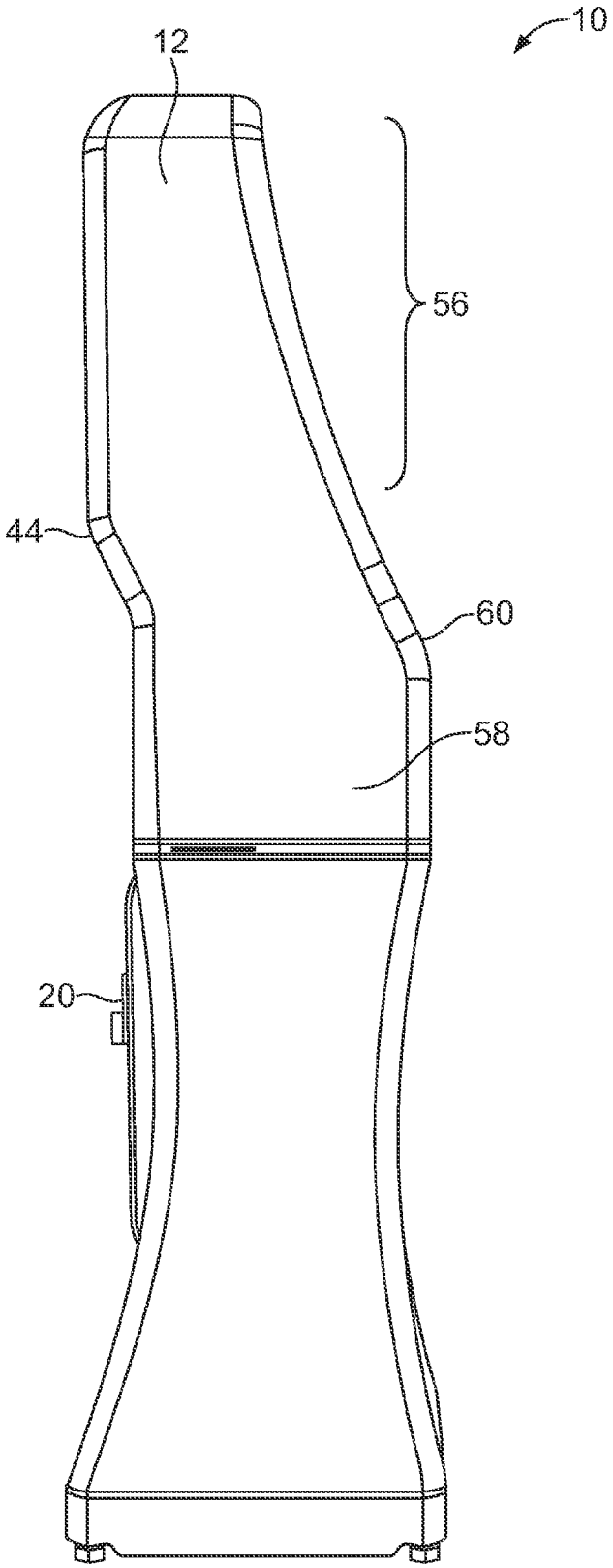
FIG. 5 illustrates a side view of a cabinet of a gaming machine that has an offset upper portion according to an illustrated embodiment of the present invention.

FIG. 5 illustrates a side view of a cabinet 12 for the gaming machine 10 according to an illustrated embodiment. As shown, according to certain embodiments, the cabinet 12 may be a floor standing unit. Additionally, the cabinet 12 may include an upper portion 56 that is positioned above a body portion 58 of the cabinet 12. The upper portion 56 of the cabinet 12 is configured to house the target assembly 16. The body portion 58 of the cabinet 12 may be have a depth sufficient to prevent interference between the game board 22 and the wall, back drop, or other surface adjacent to the back portion 60 of the cabinet 12 as the game board 22 is axially rotated, such as, for example, when the game board 22 is rotated between the first and the second positions, and vice versa. As shown in FIG. 5, in the illustrated embodiment, the back portion 60 along the upper portion 56 of the cabinet 12 may also offset from the back portion 60 along the body portion 58. This offset may further assist in preventing interference between a wall adjacent to the back portion 60 and the game board 22 when the game board 22 is being axially rotated.

Figure 6:
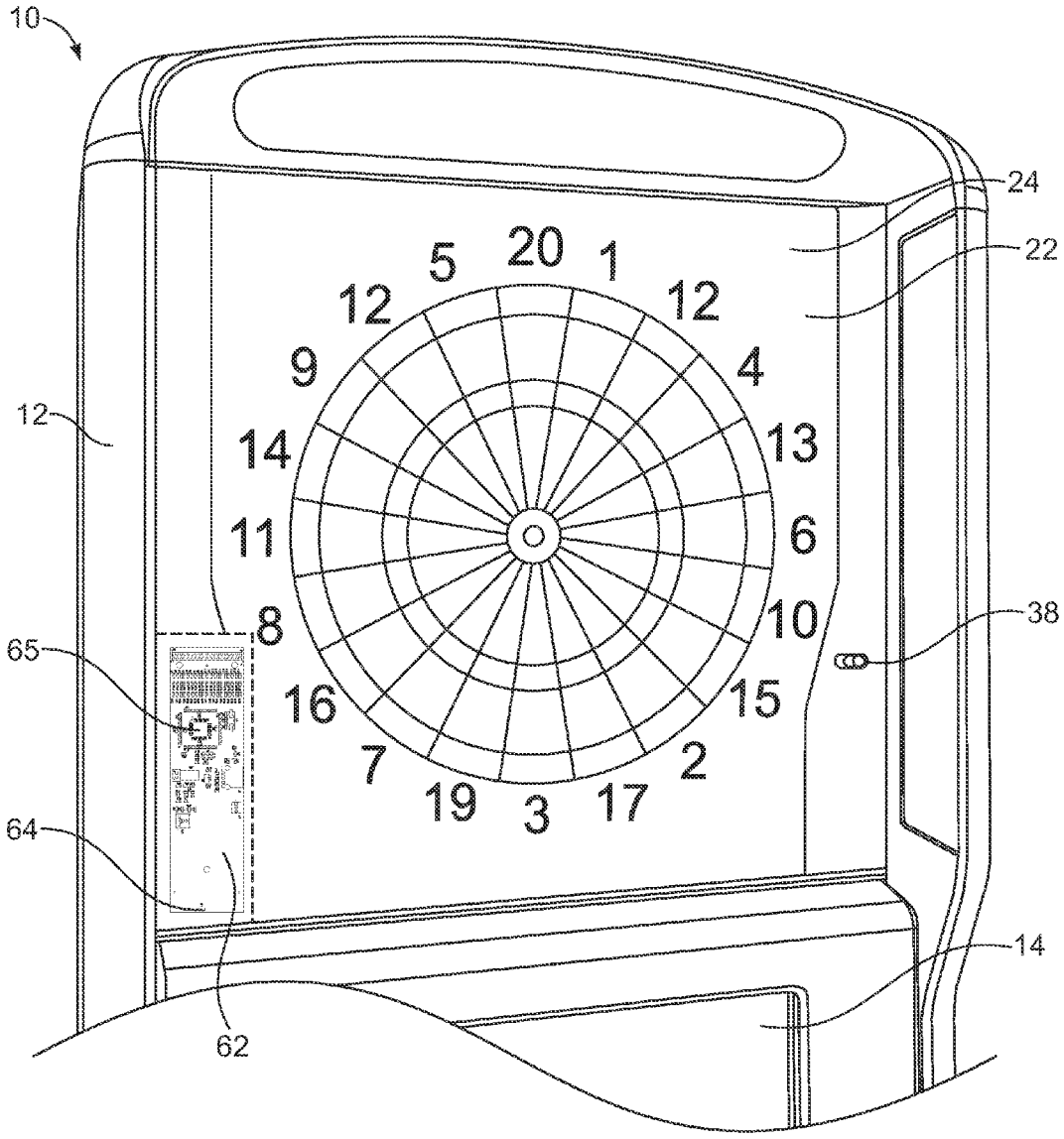
FIG. 6 is a partially cut-away view of a printed circuit board (PCB) housed in the game board of the target assembly according to an illustrated embodiment of the present invention.
Figure 7:
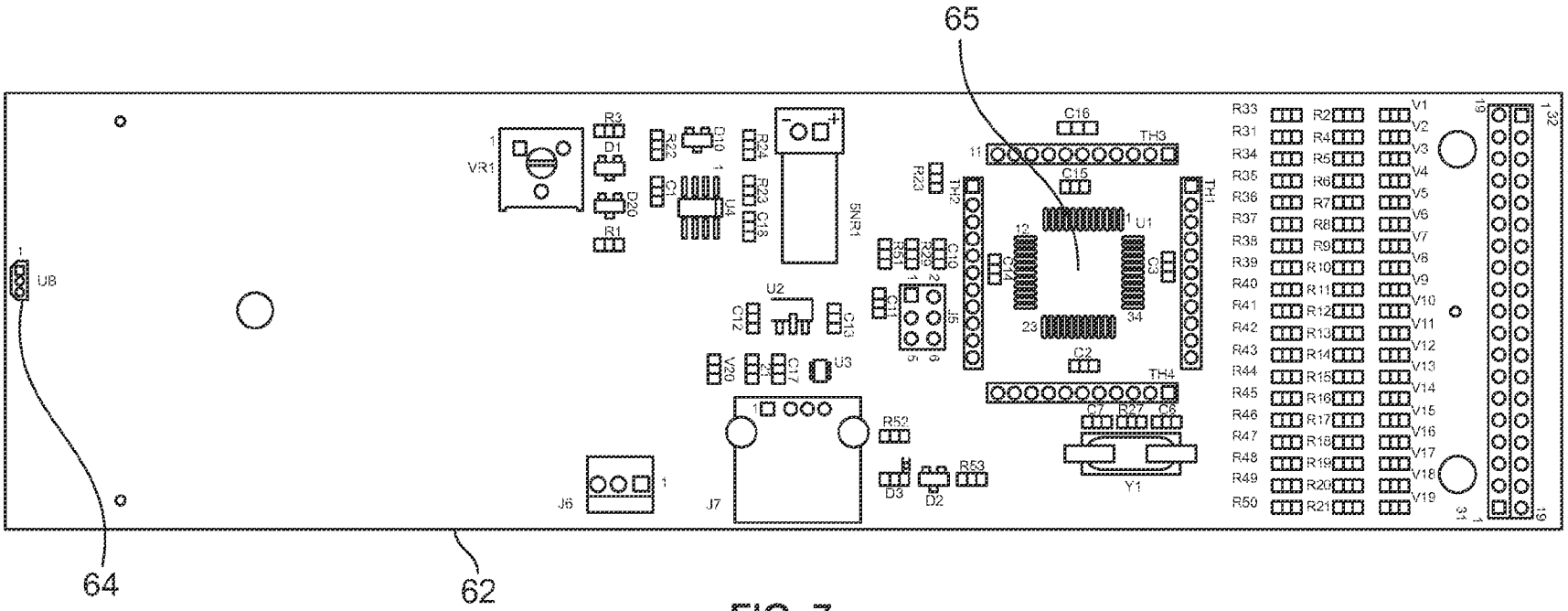
FIG. 7 is a partial PCB layout showing the location of a magnetic field detector according to an illustrated embodiment of the present invention.

The gaming machine 10 may also include a game controller involved with tracking player activity with respect to the target sides 24, 26 of the game board 22, such as, for example, the main game controller or a peripheral game controller 65. For example, FIG. 6 is a partial cutaway view illustrating a printed circuit board (PCB) 62 having a peripheral game controller 65 that is mounted inside the game board 22 of the target assembly 16. The PCB 62 and the peripheral game controller are also illustrated in FIG. 7. The peripheral game controller 65 may be involved in a variety of tasks associated with the score detection of game play objects. Examples of electronic scoring detection for multiple target games and/or shared scoring components include U.S. Pat. Nos. 5,020,806, 5,366,230, and 7,402,793, which are incorporated herein by reference in their entirety. For example, according to embodiments in which the first and/or second target sides 24, 26 are configured to provide an electronic dart game(s), the target sides 24, 26 may include of a plurality of segments, such as scoring and non-scoring segments, that are positioned to provide an array for the appropriate game to be played. Behind each segment may be a means of detecting the impact of a dart hitting that particular scoring or non-scoring segment. This detection may then be routed to the peripheral game controller 65, at which time this detection may be given a specific value. This value may then be transmitted to a main game controller, where the value may be processed and applied to the current game being played. Accordingly, the peripheral game controller 65 may be used in the allocation of a score to a player(s) when the game play object is detected as having landed on and/or hits a portion of scoring target segment, such as, for example, a dart that lands on the bulls-eye of a dart board game. The peripheral game controller 65 may also be used in the determination of whether a game play object that has landed on a scoring target segment for sufficient time to be deemed a legitimate scoring event. Additionally, according to certain embodiments, the peripheral game controller 65 may perform required communications with the main game controller of the game machine 10, including transmitting and receiving as necessary all pertinent data to allow the electronic or automatic game play scoring activity to occur during game play.

In the illustrated embodiment, the peripheral game controller 65 is operably connected to a detector 64 that is used in the detection of the position of the game board 22 relative to the cabinet 12. For example, the detector 64 may be used in the detection of which target side 24, 26 is and/or is not facing the front portion 44 of the cabinet 12. Moreover, the detector 64 may provide a signal or other instruction that the peripheral game controller 65 uses to determine which target side 24, 26 is currently properly positioned for game play. Further, the detection or determination of the positioning of the game target sides 24, 26 may allow the peripheral game controller 65 to determine which target side 24, 26 is to be monitored during that period of game play for purposes of score detection. For example, if the first target side 24 is detected to be in a first, or front facing, position relative to the cabinet 12, then the peripheral game controller 65 may determine that detected scoring events during game play of the first target side 24 are to be recognized, while detected scoring or non-scoring events involving other target sides 26 are to be disregarded. According to certain embodiments, the peripheral game controller 65 may even deactivate target sides 24, 26 that the peripheral game controller 65 determines are not currently in a forward facing position. Such detection of position of the game board 22 and which target sides 24, 26 are to be monitored, ignored, and/or deactivated for purposes of game play activities allows for the same peripheral game controller 65 to be used for different games, such as games on different target sides 24, 26.

The detection of the orientation of the game board 22, such as whether the game board 22 is in the first or second position can be achieved by a variety of different ways, including both passive and active means. For example, the positioning of the game board 22 relative to the cabinet 12 may be determined by the use of optical sensors (both reflective and interrupted beam), inductive sensing, capacitive sensing, ultra-sonic sensing, mechanical switch means using an actuator and movable contact, among others. For example, in the illustrated embodiment, the detector 64 may be a magnetic field detector, such as a linear Hall Effect sensor, that is configured to detect a magnetic field of at least one magnet or other magnetic material 66*a*, 66*b* that is mounted in or to the cabinet 12. For example, referencing FIG. 2, in the illustrated embodiment, the cabinet 12 includes a first magnet 66*a* and a second magnet 66*b* that are positioned below the game board 22. The magnets 66*a*, 66*b* however may be positioned in a variety of different locations, including, for example, above or to the sides of the game board 22, among others. According to certain embodiments, the magnets 66*a*, 66*b*, may be inserted into holes in bosses 67*a*, 67*b* in the cabinet 12. The first and second magnets 66*a*, 66*b* may have opposite orientations so that magnets 66*a*, 66*b* have opposite polarities facing the game board 22. The magnetic field detector is used to detect the polarities of the portion of the magnets 66*a*, 66*b* that is facing the game board 22. This detected polarity is then used by the peripheral game controller 65 to determine the orientation of the game board 22, such as whether the game board 22 is in the first or second position. By knowing the position of the game board 22, the peripheral game controller 65 may determine which game is being played. Moreover, the peripheral game controller 65 may then be able to know whether signals from the game board 22 indicative of game play are part of the current game play or are to be ignored.

For example, according to the illustrated embodiment, when the game board 22 is at the first position, the magnetic field detector is in relative close proximity to the first magnet 66*a*. The magnetic field detector may then be able to detect the polarity of the portion of the first magnet 66*a* that is facing the magnetic field detector. For example, the first magnet 66*a* may be oriented such that the north magnetic pole of the magnet 66*a* is facing toward the magnetic field detector, while the south magnetic pole of the magnet 66*a* is facing away from the magnetic field detector. With the first magnet 66*a* in this orientation, the magnetic field detector may detect the north polarity of the first magnet 66*a*.

Conversely, when in the game board 22 is moved to the second position in the illustrated embodiment, the magnetic field detector may be in proximity to a second magnet 66*b*. The second magnet 66*b* may have an orientation that is opposite of that of the first magnet 66*a*, such as having the south polarity facing the magnetic field detector. Therefore, the magnetic field detector may detect the south polarity of the second magnet 66*b* when the game board 22 is in the second position. Thus, the detection of a north or south polarity may be used to indicate whether the game board 22 is in the first or second position.

Figure 8:
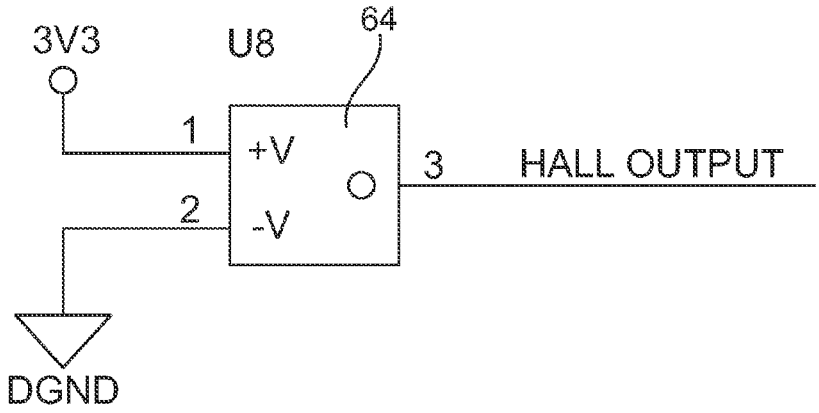
FIG. 8 is the schematic of the circuitry for a magnetic field detector according to an illustrated embodiment of the present invention.

FIG. 8 is a schematic of the circuitry of a magnetic field detector according to an illustrated embodiment. As shown, the magnetic field detector is powered by a supply voltage (3V3) while also being connected to a ground (DGND). The actual supply voltage used to power magnetic field detector may vary depending of the type of magnetic field detector employed. The magnetic field detector is also shown as outputting a voltage, which, in this example, is referenced by "HALL OUTPUT". The voltage outputted by the magnetic field detector may vary depending on the magnetic fields detected by the magnetic field detector. This outputted voltage may then be used by the peripheral game controller 65 to determine which target of the game board 22 is oriented for game play by the player, as discussed below.

Figure 9:
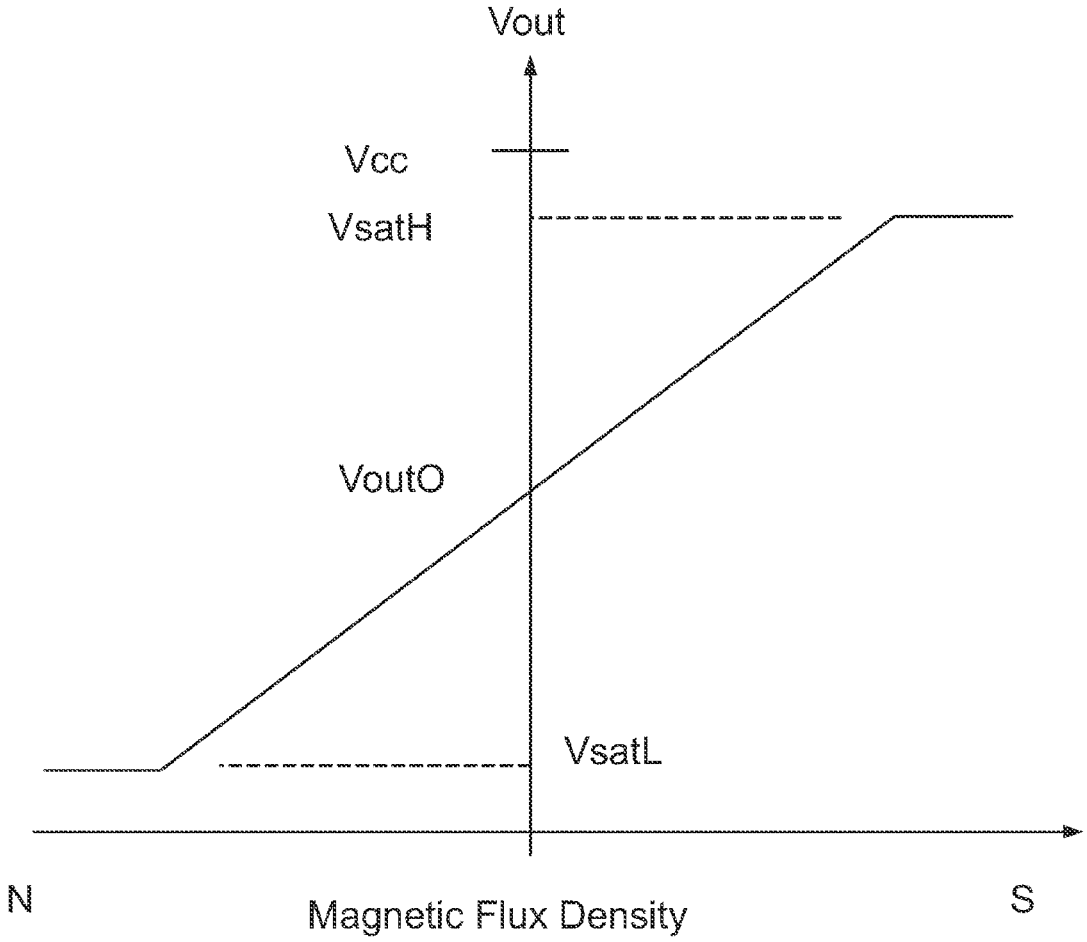
FIG. 9 illustrates exemplary trip points for the magnetic field detector according to an illustrated embodiment of the present invention.

FIG. 9 illustrates the use of outputted voltage (VoutO) from a magnetic field detector that is linear Hall Effect sensor, with "N" and "S" representing detected north and south polarities, respectively, Vout indicating the output voltage range of the magnetic field detector, and Vcc indicating a supply voltage necessary to operate electronics. Referencing the left side of FIG. 9, in the illustrated embodiment, when the magnetic field detector detects a magnetic flux density that has a primarily north polarity, the VoutO level is at a low level saturated voltage (VsatL). Conversely, referencing the right side of FIG. 9, when the magnetic field detector detects a magnetic flux density that has a primarily south polarity, the VoutO level is at a high level saturated voltage (VsatH). Further, as shown, the VoutO level may vary between the VsatL and VsatH levels based on the degree that the magnetic field detector detects north and/or south polarities. For example, when the game board 22 is in a latched at a first position, the magnetic field detector may be in close proximity to the north magnetic pole of the first magnet 66*a*. At this position, the VoutO level may be at a VsatL level. As the game board 22 is rotated toward the second position, and the magnetic field detector is being moved away from the first magnet 66*a*, the VoutO level may change, such as increase, as shown in FIG. 9. As the game board 22 continues to be rotated, the VoutO may reach an indeterminate level or range between VsatL and VsatH, which may indicate that the game board has been rotated to a position somewhere between the first and second positions. The VoutO level may continue to increase as the magnetic field detector comes into closer proximity to the south magnetic pole of the second magnet 66*b* and may reach the VsatH level when the game board 22 is latched at, or in proximity to being at, the second position.

The VoutO level may be monitored by the game controller, such as, for example, the peripheral game controller 65, to determine the position of the game board 22. In such an embodiment, the VoutO level may be used by the peripheral game controller 65 to determine which target side 24, 26 of the game board 22 to monitor for purposes of game play events, including, for example, detection of scoring on the target side 24, 26 presently positioned for game play relative to the game cabinet 12. For example, an indication that the VoutO level is at or within a predetermined range of the VsatL level may indicate to the peripheral game controller 65 that the game board 22 is at the first position, where the first target side 24 is in the first or forward facing position relative to the cabinet 12. The peripheral game controller 65 may then monitor game play on the first target side 24 of the game board 22, such, for example, detecting a scoring or non-scoring events during game play of the first target side 24.

The VoutO level may also indicate to the peripheral game controller 65 which target side 24, 26 is not being played, such as which target side 24, 26 is currently in the second or rearward facing position relative to the cabinet 12 so as to prevent the award or allocation of points or prizes due to scoring on the rearward facing target side 24, 26. According to certain embodiments, the peripheral game controller 65 may deactivate the rearward facing target side 24, 26, such as, for example, by stopping the delivery of electricity needed for game play of the rearward facing target side 24, 26 and/or deactivating detection of scoring or non-scoring events on the rearward facing target side 24, 26. Such deactivation may prevent inadvertent or improper scoring or non-scoring activity when the opposite, forward facing target side 24, 26 is being played. Further, the peripheral game controller 65 may similarly deactivate both target sides 24, 26 when the indeterminate VoutO level indicates to the peripheral game controller 65 that the position of the game board 22 is being changed. Such deactivation while the position of the game board is being changed may prevent the peripheral game controller 65 from erroneously detecting a scoring or non-scoring game play event due to contact with a target side 24, 26 during rotation of the game board 22.

According to certain embodiments, the latch mechanism 36 may include a sensor that is used to provide a signal to the peripheral game controller 65 that indicates when the game board 22 is going to be rotated so that contact with the target side 24, 26 is not interpreted by the peripheral game controller 65 as a scoring or non-scoring game play event. For example, the latch mechanism 36 may include a capacitive sensor that is senses that a player is in contact with the handle 38. A signal may then been provided to the peripheral game controller 65 that indicates that the player is in contact with the handle 38 and that the peripheral game controller 65 should at least temporarily suspend detection of scoring and non-scoring game play events.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A gaming machine having a game controller, the gaming machine comprising:

a cabinet having a front portion and a back portion;

a game board rotatably secured to the cabinet, the game board having a first target side, a second target side, and a detector, the first target side being configured for game play of a first game, the second target side being configured for game play of a second game, the game board being rotatable about the cabinet between at least a first position and a second position, the first target side facing the front portion when the game board is in a first position and the second target side facing the front portion when the game board is in the second position, the detector being configured for the detection of a position of the game board relative to the cabinet, the game controller configured to determine whether the game board is in the first or second position based on the position of the game board detected by the detector; and a latch mechanism operably connected to the game board and configured to engage the cabinet to releasably retain the game board in a first or second position, the latch mechanism having a handle and a bolt wherein the first and second target sides are electronic dart games, and wherein the game controller is configured to deactivate the second target side when the game board is in the first position;

wherein the game controller is configured to detect whether the game board is positioned at an indeterminate position between the first and second positions, the game controller being further configured to deactivate both the first and second target sides when the game board is determined to be in an indeterminate position;

wherein the latch mechanism further includes at least one reinforcement protection block adjacent to the bolt that is configured to be received in recesses on the sides of the cabinet, the at least one reinforcement block configured to limit the movement of the game board when the game board is retained in the first or the second positions; and wherein the latch mechanism includes a sensor configured to indicate user contact of the handle, and wherein the game controller is configured to deactivate the first and second target sides based on the sensed user contact with the handle.

2. The gaming machine of claim 1, wherein the detector is a magnetic field detector, and wherein the cabinet includes a first magnet and a second magnet, the first magnet being oriented such that the magnetic field detector primarily detects a magnetic field associated with the first magnet having a polarity that is different than a polarity of the second magnet detected by the magnetic field detector, and wherein the game controller is configured to determine the position of the game board based on the polarity of the magnetic field detected by the magnetic field detector.

3. The gaming machine of claim 1, wherein the same game controller is used for score detection for both the first target side and the second target side.

4. The gaming machine of claim 3, wherein the game board is configured to be rotated up to approximately 180 degrees.

5. A gaming machine comprising:

a cabinet;

a target assembly secured to the cabinet, the target assembly having a multi-sided game board, a game controller, and a magnetic field detector, the multi-sided game board being rotatable about the cabinet between at least a first position and a second position, the multi-sided game board further including at least two target sides configured for play of electronic target game, the magnetic field detector being configured to detect a magnetic field generated by one or more magnets positioned in the cabinet, the game controller configured to determine whether the multi-sided game board is in a first or second position based on the polarity of the magnetic field detected by the magnetic field detector wherein the one or more magnets include a first magnet and a second magnet, the first magnet being positioned in proximity to a first side of the cabinet, the second magnet being position in proximity to a second side of the cabinet, the first magnet being oriented such that the magnetic field detector detects magnetic field having a polarity that is different than a polarity of the second magnet detected by the magnetic field detector.

6. The gaming machine of claim 5, wherein the multi-sided game board is configured to be rotated up to approximately 180 degrees.

7. The gaming machine of claim 6, wherein the same game controller is used for score detection for both the first target side and the second target side.

8. The gaming machine of claim 7, wherein the electronic target game of the first target side is different than the electronic target game of the second target side, and wherein the game controller is configured to deactivate the second target side when the game board is in the first position.

9. The gaming machine of claim 7, wherein the game controller is configured to detect whether the multi-sided game board is positioned at an indeterminate position between the first and second positions, the game controller being further configured to deactivate both the first and second target sides when the multi-sided game board is determined to be in an indeterminate position.

10. The gaming machine of claim 9, wherein the gaming machine further includes a latch mechanism configured to engage the cabinet to releasably retain the multi-sided game board in a first or second position, the latch mechanism having a handle and a bolt, the bolt being biased in a locked position, at least a portion of the handle configured to extend through an opening in the game board.

11. The gaming machine of claim 10, wherein the latch mechanism includes a sensor configured to indicate user contact of the handle, and wherein the game controller is configured to deactivate the first and second target sides based on the sensed user contact with the handle.

12. A gaming machine comprising:

a cabinet having a first side and a second side; and a target assembly secured to the cabinet, the target assembly having a multi-sided game board, a game controller, and a magnetic field detector, the multi-sided game board being rotatable about the cabinet between at least a first position and a second position, the multi-sided game board further including at least two target sides configured for play of electronic dart games, the magnetic field detector being configured to detect a first magnetic field generated by a first magnet positioned in proximity to the first side of the cabinet, and a second magnetic field generated by a second magnet positioned in proximity to the second side of the cabinet, the first and second magnetic fields having a different polarity, the game controller configured to determine whether the multi-sided game board is in a first or second position based on the polarity of the magnetic field detected by the magnetic field detector; and wherein the game controller used for score detection for the first target side is the same game controller used for score detection for the second target side.

13. The gaming machine of claim 12, wherein the cabinet is configured to house a video display.

14. The gaming machine of claim 12, further including a payment mechanism operably connected to the cabinet.

15. The gaming machine of claim 12, wherein the cabinet is a floor standing cabinet having an upper portion, a body portion, and a back portion, the upper portion configured to house at least a portion of the multi-target game board, the back portion along the upper portion being inwardly offset from the back portion along the body portion.

* * * * *